United States Patent [19]

Deutsch

[11] 4,033,219

[45] July 5, 1977

[54] TOUCH RESPONSIVE CONTROL SYSTEM FOR A KEYBOARD ELECTRONIC MUSICAL INSTRUMENT

[75] Inventor: Ralph Deutsch, Sherman Oaks, Calif.

[73] Assignee: Nippon Gakki Seizo Kabushiki Kaisha, Hamamatsu, Japan

[22] Filed: Feb. 27, 1975

[21] Appl. No.: 553,585

[52] U.S. Cl. ..... 84/1.03; 84/1.01; 84/1.13; 84/1.24; 84/1.26

[51] Int. Cl.[2] ..... G10H 1/02; G10H 3/00

[58] Field of Search ..... 84/1.01, 1.03, 1.09, 84/1.1, 1.13, 1.24, 1.26, 1.27

[56] References Cited

UNITED STATES PATENTS

| | | | |
|---|---|---|---|
| 3,515,792 | 6/1970 | Deutsch | 84/1.03 |
| 3,617,604 | 11/1971 | Adachi | 84/1.19 |
| 3,809,786 | 5/1974 | Deutsch | 84/1.01 |
| 3,823,390 | 7/1974 | Tomisawa | 340/172.5 |
| 3,882,751 | 5/1975 | Tomisawa | 84/1.1 |
| 3,902,398 | 12/1973 | Nakada et al. | 84/DIG. 19 |
| 3,910,150 | 10/1975 | Deutsch et al. | 84/1.26 |

*Primary Examiner*—E. S. Jackmon
*Attorney, Agent, or Firm*—Howard A. Silber

[57] ABSTRACT

Touch responsive control of note amplitude and harmonic content is achieved by providing each key with a touch responsive transducer. A set of attack/decay scale factors are accessed sequentially from a memory and used to establish the amplitude envelope of the generated note. The accessed scale factors are modified by the transducer output to effectuate touch responsive amplitude control. In a preferred embodiment, scale factors stored in consecutive memory locations define a piano-like attack/decay envelope. The transducer output sets the initial memory access location, so that the harder the key is struck, the greater the initial amplitude of the generated note.

Other embodiments include touch responsive control of the constituent Fourier components of the generated tone; and utilization of multiplexing for time shared connection of plural analog touch responsive transducers to a single analog to digital converter. A touch responsive transducer is disclosed that utilizes a force-reducing air pressure cylinder to drive a code wheel which provides a digital output signal indicative of the force with which the key is struck.

13 Claims, 6 Drawing Figures

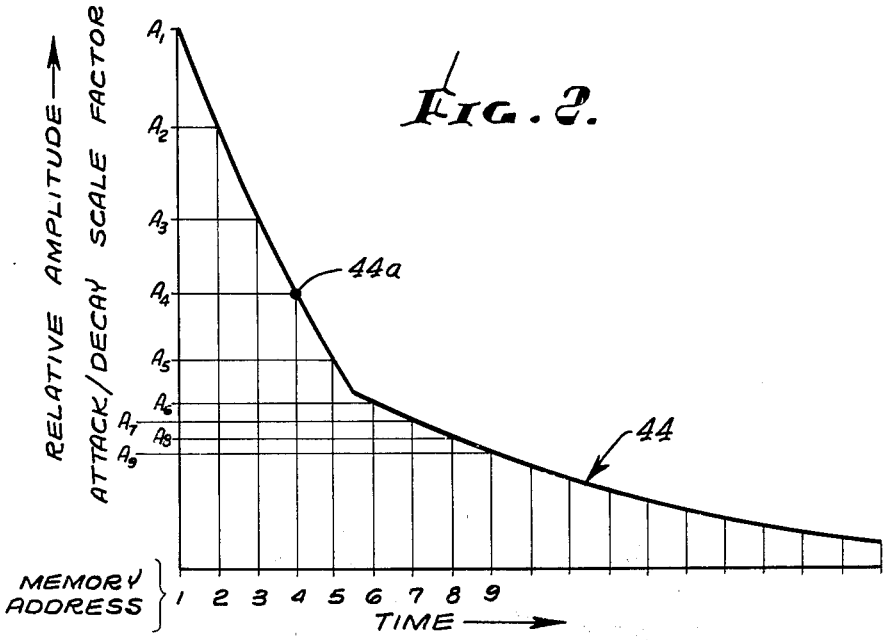
FIG. 2.
FIG. 6.
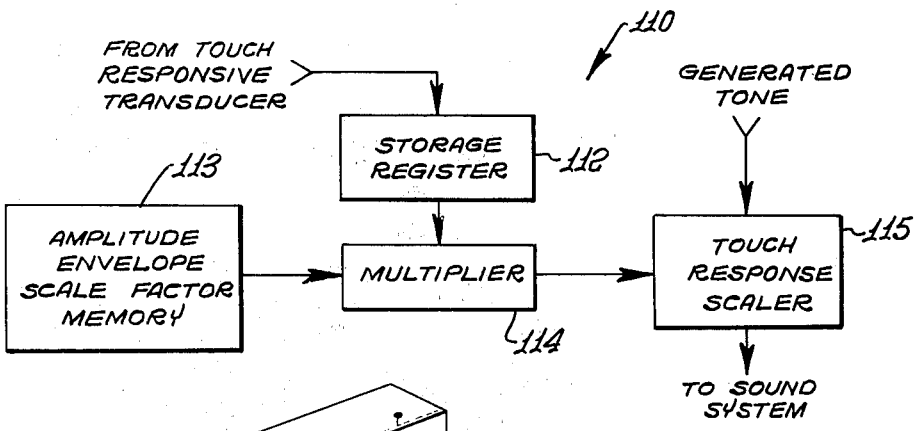
FIG. 5.
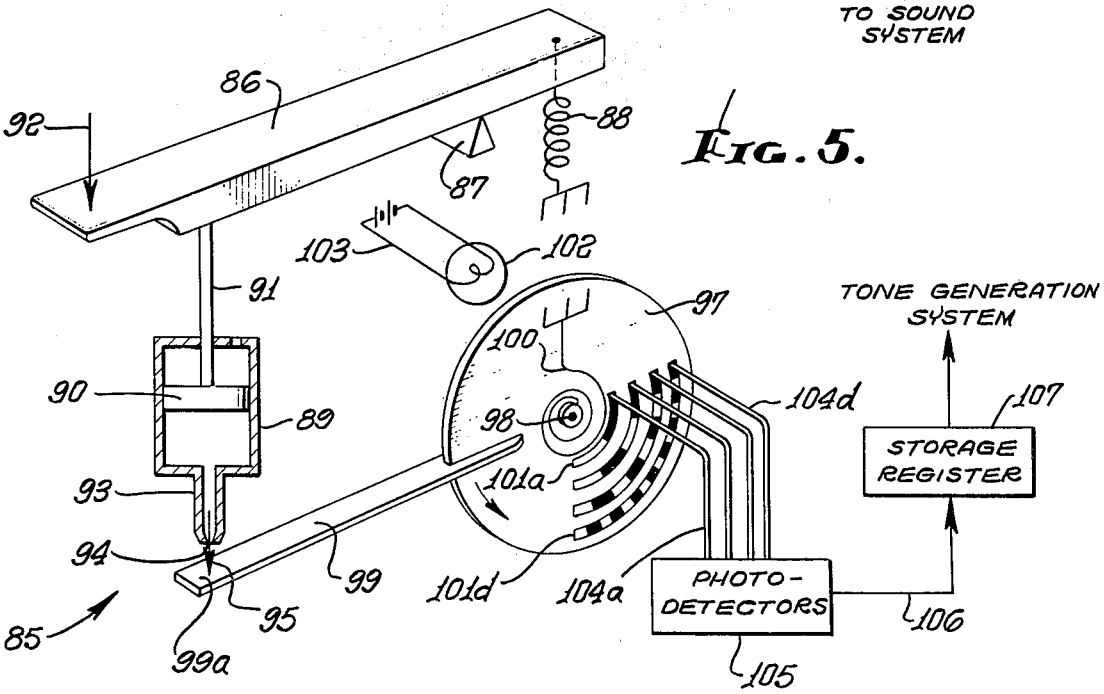

TOUCH RESPONSIVE CONTROL SYSTEM FOR A KEYBOARD ELECTRONIC MUSICAL INSTRUMENT

BACKGROUND OF THE INVENTION

1. Field of the Invention

The present invention relates to touch responsive control of a computor organ or other keyboard electronic musical instrument.

2. Description of the Prior Art

In a conventional piano, both the maximum amplitude and harmonic content of each note will depend on the force and/or velocity with which the key is struck. In general, the harder the key is depressed, the greater will be both the maximum amplitude and the harmonic content. If a softer touch is used, the maximum amplitude will be less, and there will be fewer higher order harmonics present in the spectrum of the produced sound. A principal object of the present invention is to implement such touch response in an electronic musical instrument.

Although touch responsive transducers per se are known, another object of the present invention is to provide such a transducer having a digital output which is directly usable with a digital tone synthesizer. A further object is to facilitate the use of analog touch transducers in a digital musical instrument, by employing a single analog-to-digital converter that is shared by plural transducers.

The disclosed touch responsive system advantageously is used with the COMPUTOR ORGAN disclosed in the inventor's U.S. Pat. No. 3,809,786. In such instrument, the Fourier components of a musical sound are individually controlled in amplitude by harmonic coefficients $C_n$ associated with each harmonic order $n$. An object of the present invention is to implement touch responsive control of both amplitude and harmonic content in such a computor organ. However, the invention is not limited to use with the patented computor organ, but may be utilized with other electronic musical instruments in which the amplitude envelope is controlled by an amplitude scale factor. Thus the invention also may be used with a digital organ of the type disclosed in the inventor's U.S. Pat. No. 3,515,792 wherein musical tones are generated by repetitively accessing a waveshape stored in a memory.

SUMMARY OF THE INVENTION

Certain of these objectives are achieved by storing in a memory a set of amplitude scale factors that are accessed sequentially to define a piano-like or other attach/decay amplitude envelope. The address of the initially accessed scale factor is controlled by a touch responsive transducer associated with the selected key. If the key is depressed with maximum force or velocity, the entire scale factor set is accessed, so that maximum amplitude is achieved. If a softer touch is used, accessing of the scale factor memory begins from a later address, so that the attack/decay amplitude envelope starts at a lower level.

In an alternative embodiment, the touch responsive transducer output also controls the harmonic content of the generated tone. This is accomplished in a computer organ by using the transducer signal to set the value $n_{max}$ of the highest order Fourier component included in the musical note synthesis. If the key is struck with harder force, more Fourier components are present in the resultant tone than if a softer touch is used.

The touch response transducer output may be used directly to scale the amplitude envelope of the generated tone. For example, the attack, decay and other amplitude scale factor used by the associated musical instrument may be multiplied by a value proportional to the touch response transducer output.

In digital systems using analog touch response transducers, a single analog-to-digital converter may be time shared by many such transducers. To this end, the transducer outputs may be multiplexed or otherwise selectively gated to the A-to-D converter when the key is struck.

BRIEF DESCRIPTION OF THE DRAWINGS

A detailed description of the drawings of the invention will be made with reference to the accompanying drawings wherein like numerals designate corresponding elements in the several figures. Certain illustrated components correspond to those in FIG. 1 of the U.S. Pat. No. 3,809,786. In such instances, the same designating numerals have been used and such numerals are underlined to indicate that the components are the same as in that patent.

FIG. 2 is a graph showing a typical piano-like amplitude envelope, and indicating relative attack/decay scale factor values that may be employed in the system of FIG. 1.

FIG. 5 is a schematic mechanical drawing of a touch responsive transducer that provides a digital output.

FIG. 6 is an electrical block diagram illustrating another touch responsive control system.

DESCRIPTION OF THE PREFERRED EMBODIMENTS

The following detailed description is of the best presently contemplated modes of carrying out the invention. This description is not to be taken in a limiting sense, but is made merely for the purpose of illustrating the general principles of the invention since the scope of the invention best is defined by the appended claims.

Operational characteristics attributed to forms of the invention first described also shall be attributed to forms later described, unless such characteristics obviously are inapplicable unless specific exception is made.

Figure 1:
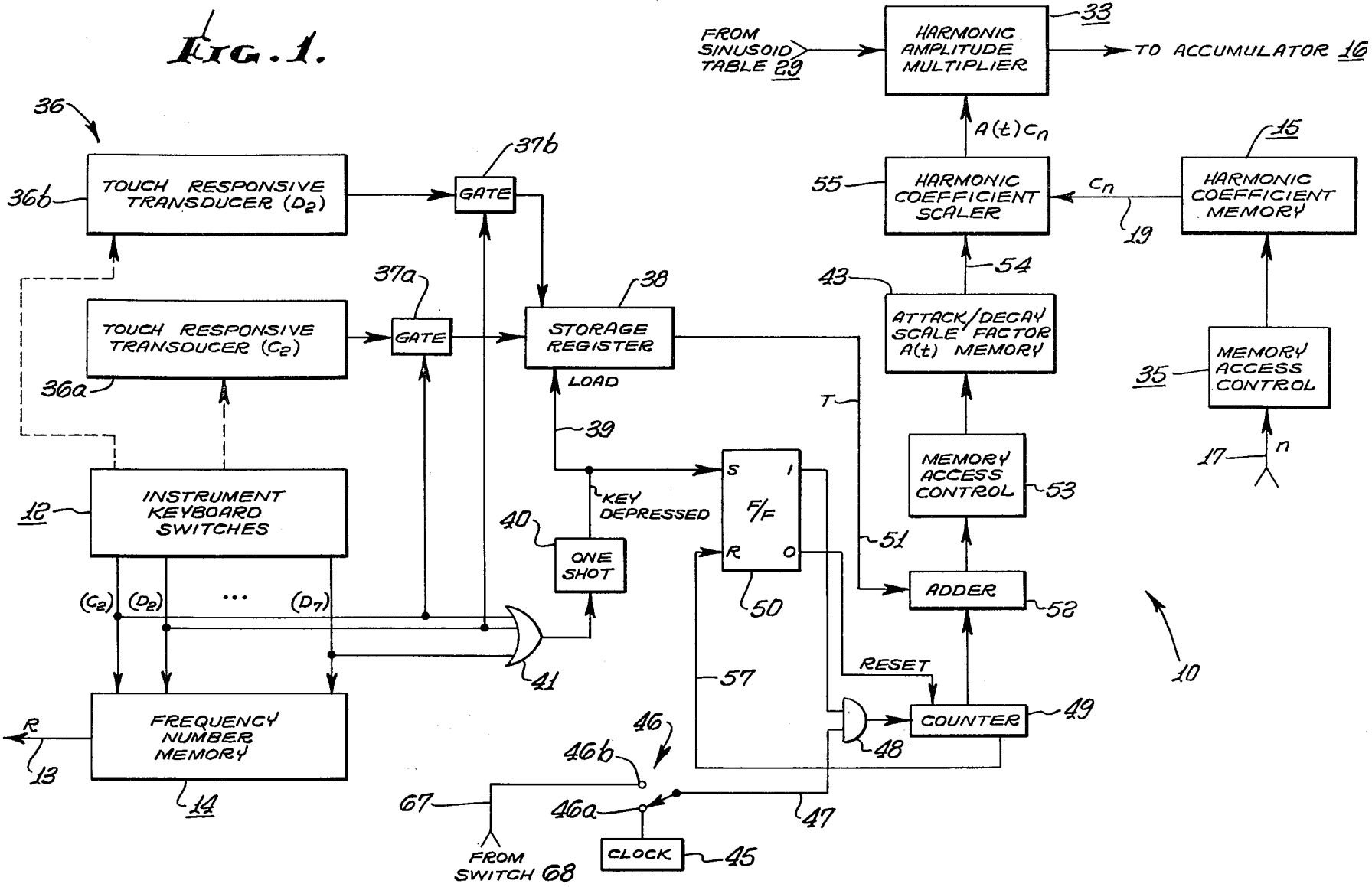
FIG. 1 is an electrical block diagram of a touch responsive amplitude envelope control system for an electronic musical instrument.

The touch responsive system 10 of FIG. 1 is illustrated in conjunction with a computer organ of the type disclosed in the above mentioned U.S. Pat. No. 3,809,786. In such an instrument, notes are selected by keyboard switches 12 actuated when the corresponding keys are depressed. The fundamental frequency of the generated note is established by a frequency number R that is supplied on a line 13 from a memory 14 which is accessed in response to closure of a keyboard switch. The computer organ generates a musical waveshape by a separately calculating the constituent Fourier components and summing these in an accumulator to obtain the waveshape amplitudes at successive sample points. These sample point amplitudes are converted to musical sounds as the computations are carried out in real time.

The relative amplitude of each constituent Fourier component is established by a harmonic coefficient $C_n$ which is supplied from a memory 15. The memory 15 is accessed by a control circuit 35 in response to a signal on a line 17 that designates the order $n$ of the Fourier component currently being evaluated by the computor organ. The accessed coefficient $C_n$ is supplied on a line 19 for utilization as described below.

In accordance with the present invention, the amplitude envelope of each generated tone is controlled in response to the keyboard touch. To this end, each instrument keyboard key is provided with a touch responsive transducer 36*a*, 36*b* . . . that provides an output proportional to the force with which the key is struck. Alternatively, each transducer 36 output may be proportional to the velocity of the key at some specified point in its downward travel. Advantageously each transducer 36 provides a digital output to a respective gate 37*a*, 37*b* . . . that is enabled by the corresponding keyboard switch 12. For example, if the key for the note $C_2$ is struck, the output of the transducer 36*a* for that key will be supplied via the enabled gate 37*a* to a storage register 38.

As the key is struck, a "key depressed" signal on a line 39 causes the operative transducer 36 output to be loaded into the storage register 38. The "key depressed" signal itself is obtained from a one-shot multivibrator 40 that is triggered by the output of an OR gate 41 which is connected to all of the keyboard switches 12.

The desired amplitude envelope is defined by a set of attack/decay scale factors A(t) that is stored in a memory 43. Advantageously, but not necessarily, these scale factors A(t) may define a piano-like amplitude envelope such as that shown by the curve 44 in FIG. 2. The abscissa indicates the memory 43 address, and the ordinate indicates the relative amplitude scale factor A(t) stored at the corresponding memory address. If the scale factors A(t) are accessed from consecutive memory address locations at regular time intervals and utilized as described below, the generated tone will exhibit the amplitude envelope 44 illustrated in FIG. 2.

In accordance with the present invention, touch responsive amplitude control is achieved by accessing scale factors from the memory 43 beginning at an initial address that is controlled by the output of the touch reponsive transducer 36. Thus, if the key is struck with maximum force, the corresponding transducer 36 output will cause the entire set of scale factors A(t) to be read from the memory 43 beginning at address "1." A note of maximum amplitude will result. If a softer touch is used, accessing of the scale factor memory 43 will begin at a later address. For example, the output of the touch responsive transducer 36 may cause the scale factor memory 43 initially to be accessed at the address "4." The resultant amplitude envelope will begin at the point designated 44*a* in FIG. 2, with an initial amplitude of $A_4$.

The rate at which successive scale factors A(t) are accessed from the memory 43 may be controlled by a clock 45 that provides timing pulses via the contact 46*a* of a switch 46 to a line 47. These timing pulses are gated via an AND gate 48 to a counter 49 beginning at the time that the key is depressed. To this end, the "key depressed" signal on the line 39 sets a flip-flop 50 to the "1" state so as to enable the AND gate 48. The counter 49 initially is reset to zero, and the contents of the counter 49 is incremented by units at the clock 45 rate.

In the embodiment of FIG. 1, each transducer 36 advantageously provides an output consisting of a digital number T that is inversely proportional to the key velocity or depression force. Thus if the key is struck with maximum force, the storage register 38 will contain the value T=0. If the key is struck with minimum force, the storage register 38 will contain the value $T=T_m$. Values of $T$ intermediate 0 and $T_m$ indicate that the key has been struck with a proportionate intermediate force.

The contents T of the storage register 38 is supplied via a line 51 to an adder 52 where it is summed with the contents of the counter 49. The sum, representing the access address for the scale factor memory 43, is supplied to an access control circuit 53. As a result, the corresponding attack/decay scale factor A(t) is accessed from the memory 43 and supplied on a line 54 to a harmonic coefficient scaler 55.

If the key is struck with maximum force, T=O so that the first access address will be "1," corresponding to the initial incremented contents of the counter 49. However if an intermediate striking force is used, producing a transducer 36 output of say T=3, then the first address supplied from the adder 52 will be (1+3)=4 so that the scale factor $A_4$ initially is accessed.

In the scaler 55, the harmonic coefficient $C_n$ currently being supplied on the line 19 is multiplied by the accessed scale factor A(t) and the product is supplied to a harmonic amplitude multiplier 33. There, the scaled harmonic coefficient value $A(t)C_n$ is used to establish the amplitude of the $n^{th}$ Fourier component currently being evaluated by the computor organ.

As a result of this scaling, the generated tone will exhibit an amplitude envelope defined by the subset of attack/decay scale factors A(t) accessed from the memory 43. Since the initial memory access address is established by the touch response transducer 36, the resultant tone will exhibit an amplitude that is responsive to the touch with which the instrument key was struck.

When the counter 49 has incremented to some preset value corresponding to the last access address of the scale factor memory 43, an output signal is provided from the counter 49 via a line 57. This signal resets the flip-flop 50 to the "0" state, causing the counter 49 to be reset to zero. As described in connection with FIG. 3, if the switch 46 is set to the contact 46*b*, the counter 49 may be incremented each time a certain fraction of a cycle of the selected note has been generated.

Figure 3:
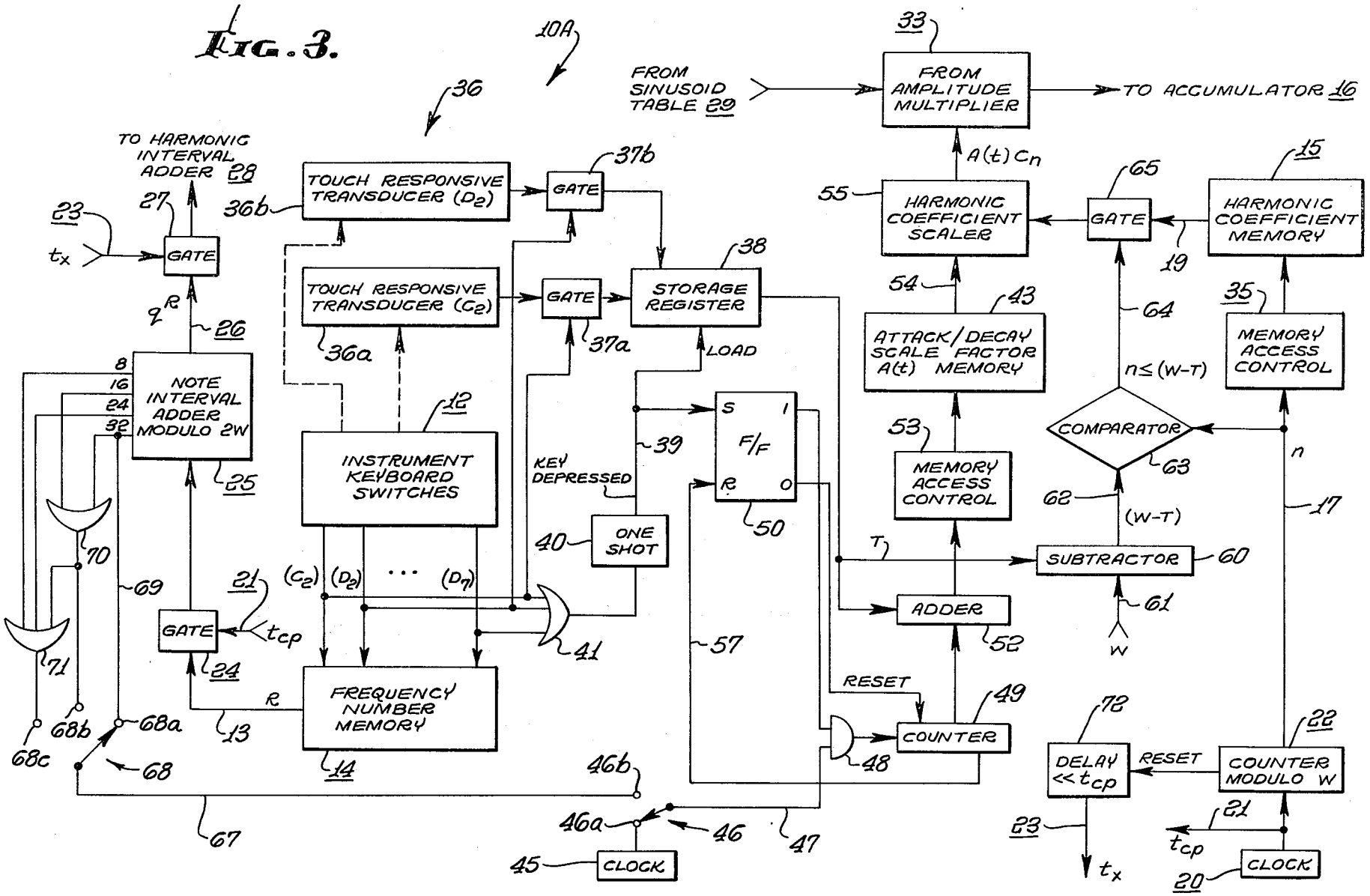
FIG. 3 is an electrical block diagram of another touch responsive system in which both the amplitude envelope and the harmonic content of the generated musical note are controlled in response to keyboard touch.

In FIG. 3, the system 10A accomplishes touch responsive amplitude control in the same manner as the system 10 of FIG. 1. In addition, the system 10A also modifies the harmonic content of the generated tone in response to the keyboard touch. In particular, the number of Fourier components included in each waveshape amplitude computation is decreased as the keyboard touch is decreased. If the key is struck with maximum force, the maximum number W of Fourier components are included in the generated tone. If a softer touch is used, the higher order Fourier components are eliminated. The output of the actuated touch response transducer is used to establish the highest order $n_{max}$ Fourier component included in the generated tone.

To this end, the order $n$ of the Fourier component currently being evaluated is established by a counter 22 which receives timing pulses $t_{cp}$ on a line 21 from the computor organ clock 20. The counter 22 is of modulo $W$, where $W$ designates the maximum number of Fourier components that can be included in any waveshape amplitude computation. The value $W=16$ is satisfactory for most musical tone synthesis. The contents of the counter 22 represents the order $n$ of the currently evaluated Fourier component; this value is supplied via the line 17 to the memory access control 35.

A subtractor 60 receives the actuated touch response transducer output T from the line 51 and a signal representing the constant value $W$ on a line 61. The subtraction circuit 60 performs the operation $(W\text{-}T)$ and provides the resultant difference value on a line 62 to a comparator 63. Here the value $(W\text{-}T)$ is compared with the current Fourier component order $n$ present on the line 17. If $n \leq (W\text{-}T)$, the comparator 63 provides an output on the line 64 which enables a gate 65. As a result, the harmonic coefficient $C_n$ corresponding to the current order $n$ is supplied from the memory 15 to the harmonic coefficient scaler 55. Thus the corresponding $n^{th}$ Fourier component is included in the waveshape computation. On the other hand, if $n > (W\text{-}T)$, no output occurs on the line 64 and the gate 65 is inhibited. As a result, the corresponding harmonic coefficient $C_n$ is not supplied to the scaler 55 and hence that scaler provides a zero output. Thus, the corresponding $n^{th}$ Fourier component is not included in the waveshape amplitude computation.

In this manner, the subtractor 60, comparator 63 and gate 65 control the note harmonic content. In the event that maximum force has been used to strike the key, the transducer 36 output stored in the register 38 has the value $T=0$. As a result, the value $(W\text{-}O)=W$ is supplied on the line 62 to the comparator 63. Thus a gate enabling signal will be present on the line 64 for all values of $n$. All of the harmonic coefficient values $C_n$ will be gated through to the scaler 55, and all $W$ Fourier component will be included in the generated tone. On the other hand, if a softer touch is used, the register 38 will store a value $T$ that is greater than zero. Some number $(W\text{-}T)$ that is less than $W=16$ will be supplied to the comparator 63. As a result whenever $n > n_{max}=(W\text{-}T)$, no enable signal will be provided from the comparator 63 and the gate 65 will be disabled. Harmonic coefficients of order $n>n_{max}$ will not be supplied to the scaler 55, and no Fourier components of order greater than $n_{max}$ will be included in the waveshape amplitude computation.

As indicated earlier, the attack/decay scale memory 43 may be accessed at a rate related to the fundamental frequency of the note being generated. To this end, the switch 46 (FIGS. 1 and 3) is set to the contact 46*b*. In this position, the counter 49 is incremented each cycle of fractional cycle of the generated note. The counter-incrementing pulses are obtained via a line 67 and a switch 68 from the note interval adder 25 used in the computor organ.

As discussed in the U.S. Pat. No. 3,809,786 the note interval adder 25 is of modulo $2W$ *where* $W$ is the highest Fourier component order included in the waveshape amplitude computation. The frequency number R accessed from the memory 14 is gated to the note interval adder 25 at each component calculation interval $t_{cp}$ by a gate 24. Thus the contents of the note interval adder 25 ranges between zero and $2W=32$ over a single period of the fundamental frequency of the generated note. The note interval adder 25 will produce an output pulse on a line 69 each time the contents of that adder reaches "32," i.e., once each cycle of the generated note. Thus when the switch 68 is set to the position 68*a*, the counter 49 will be incremented each time a full cycle of the generated note is produced.

The counter 49 can be incremented at each note half-cycle by setting the switch 68 to the position 68*b*. In this instance, pulses are obtained on the line 67 each time the note interval adder 25 reaches a count of 16 or 32. Those adder 25 outputs are supplied to the switch contact 68*b* via an OR gate 70. Similarly, an OR gate 71 supplies pulses to the switch contact 68*c* at each quarter-cycle of the generated note, when the note interval adder 25 reaches a count of 8, 16, 24 or 32.

The contents of the note interval adder 25 corresponds to the value $q$R that defines the sample point at which the waveshape amplitude currently is being calculated. This value is supplied to a harmonic interval adder 28 via a line 26 and a gate 27 that is enabled by a computation interval pulse $t_x$ on the line 23. This $t_x$ pulse is derived from the counter 22 by slightly delaying the reset pulse of that counter in a delay circuit 72.

Figure 4:
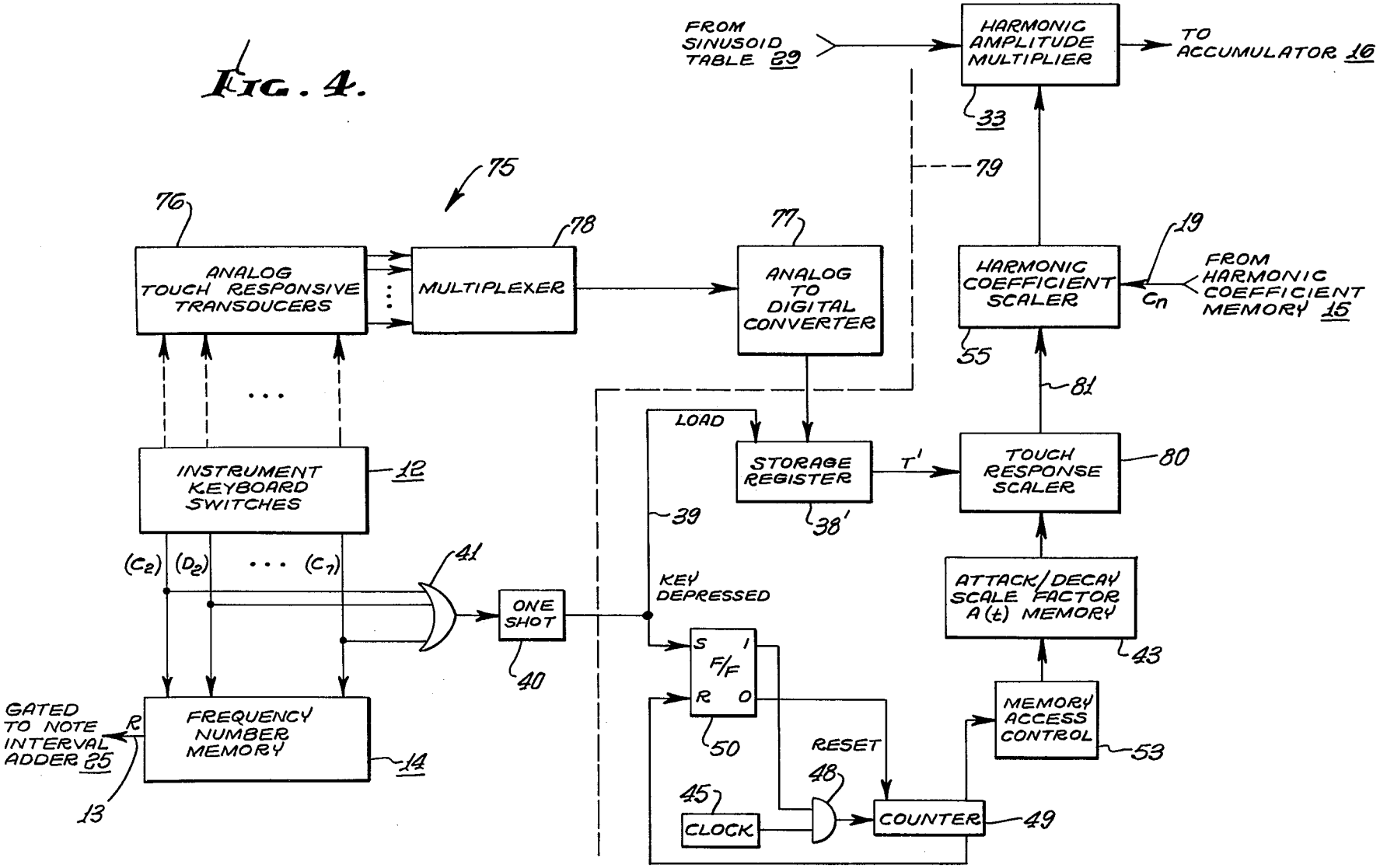
FIG. 4 is an electrical block diagram showing the use of analog touch responsive transducers and a single analog to digital converter in conjunction with a digital electronic musical instrument.

Another touch responsive system 75 is shown in FIG. 4. In this system, each instrument key has an analog touch responsive transducer 76. These are connected to a single analog-to-digital converter 77 by a multiplexer 78. With this arrangement, only one analog-to-digital converter is necessary, thereby considerably reducing system cost as compared to an arrangement where individual A-to-D converters were used with each of the analog transducers 76.

The output of the A-to-D converter 77 is supplied to a storage register 38' associated with the tone generation circuitry for the selected note. In a polyphonic instrument, this generation circuitry, including the touch response components shown to the right of a broken line 79 in FIG. 4, would be replicated for the number of notes that can be played simultaneously. The multiplexer 76 insures correct assignment of each transducer 76 output to the note generation circuitry associated with the selected key to which that transducer is attached.

In the system 75, the digitalized transducer output T' stored in the register 38' is used directly to scale the attack/delay scale factors A(t) accessed from the memory 43. To this end, the memory access control 53 directly receives the output of the counter 49, so that the scale factors A(t) are read out from successive memory locations beginning from the first address "1." The accessed scale factors are multiplied by the transducer output T' by a multiplier circuit herein called a touch response scaler 80. The product $T'A(t)$ is supplied via a line 81 to the harmonic coefficient scaler 55 where it is multiplied by the harmonic coefficient $C_n$ supplied on the line 19. The product $T'A(t)C_n$ then is provided to the harmonic amplitude multiplier 33 to establish the relative amplitude of the constituent Fourier component then being evaluated. In this way, independent touch responsive amplitude control is achieved of each generated note.

FIG. 5 illustrates a touch responsive transducer 85 associated with an instrument key 86. The key 86 is supported by a pivot 87 and has a restoring spring 88 that maintains the key 86 in its normal rest position.

The transducer 85 includes an air cylinder 89 containing a piston 90 that is connected to the forward end of the key 86 by a shaft 91. When the key 86 is struck in a downward direction (indicated by an arrow 92), air under pressure is forced out of the cylinder 89 via a tube 93 and an outlet port 94. The force of the air emergent from the port 94 (indicated by the arrow 95) is proportional to the force with which the key 86 is struck.

The air emergent from the cylinder 89 is used to rotate a code wheel 97 about its axis 98. For this purpose, a bar 99 affixed to the wheel 97 has an end 99*a* situated beneath the port 94 directly in the emergent air path 95. The wheel 97 rotates against the force of a coil spring 100. With this arrangement, when the key 86 is struck, the air emergent from the cylinder 89 will rotate the code wheel 97 through an angular amount proportional to the force with which the key is struck.

Contained on the wheel 97 are selectively transparent, arcuate code segments 101*a* through a 101*d*. These are illuminated by a lamp 102 and its associated voltage source 103 situated on one side of the wheel 97. On the other side there is a set of optical fibers 104*a* through 104*d* aligned with the respective coded sections 101*a* – 101*d*. These optical fibers 104*a* – 104*d* conduct light to an associated set of photodetectors 105. The segments 101*a* – 101*d* contain, in the form of transparent and opaque regions, a binary code indicative of arcuate displacement of the wheel 97. Thus, when the key 86 is struck so as to cause rotation of the wheel 97, the photodetectors 105 will supply a binary output code that is indicative of the wheel 97 angular rotation, and hence indicative of the force with which the key 86 is struck. This binary output code is supplied via a line 106 to a storage register 107 where it remains available for utilization by the associated tone generation system.

FIG. 6 shows a generalized system for touch responsive amplitude control of a generated tone. This arrangement is useful with any type of tone synthesizer system.

In the system 110 of FIG. 6, the output from a touch responsive transducer is stored in a register 112. The stored value T″ is indicative of the force with which the associated key was struck. An arbitrary set of amplitude envelope scale factors is stored in a memory 113. These factors may define an amplitude envelope such as that shown in FIG. 2, or any other desired envelope configuration. These scale factors ae accessed from the memory 113 in a time sequential manner and supplied to a multiplier 114 where they are scaled by the force-indicating value T″ stored in the register 112. The product is supplied to a touch response scaler 115 which receives the generated tone from the associated note synthesizing circuitry. In the scaler 115 this generated tone is multiplied by the product supplied from the multiplier 114, and the product supplied to the sound reproduction system. Through this operation, the produced note will exhibit an amplitude envelope that is controlled in response to the keyboard touch.

Intending to claim all novel, useful and unobvious features shown or described, the applicant claims:

1. A touch responsive system for a keyboard electronic musical instrument of the type wherein a note is generated upon depression of a corresponding key on said keyboard, comprising;

a touch responsive transducer associated with each key of said instrument, each transducer providing an output indicative of the force or velocity with which the corresponding key is depressed, a memory storing a set of amplitude scale factors in consecutive memory address locations so that a predetermined amplitude envelope will result when said scale factors are accessed sequentially, access means for accessing a subset of said scale factors from said memory in a preselected order, the accessed scale factors being utilized by said instrument to establish the amplitude envelope of the note generated upon depression of a selected key, said access means including circuitry for sequentially accessing storage locations in said memory, and control means, responsive to the output of the transducer of said selected key, for modifying the subset of scale factors accessed from said memory, so that said amplitude envelope is responsive to the touch with which said key is struck, said control means establishing, in response to said transducer output, the initial address at which said sequential accessing begins, so that the maximum envelope amplitude is established by the force or velocity with which said selected key is depressed.

2. A touch responsive system according to claim 1 wherein said stored scale factors define a piano-like attack/decay amplitude envelope.

3. A touch responsive system according to claim 1 wherein said transducer provides a digital output, and wherein said control means includes timing circuitry for establishing a time incremented count, and an adder for algebraically adding said transducer digital output to said count to obtain an address value designating the memory storage location from which a scale factor is to be accessed.

4. A touch responsive system for a keyboard electronic musical instrument, comprising;

a touch responsive transducer associated with a key of said instrument, a memory storing a set of amplitude scale factors, access means for accessing a subset of said scale factors from said memory in a preselected order, the accessed scale factors being utilized by said instrument to control the amplitude envelope of the note generated by said instrument in response to depression of said key, control means, responsive to said transducer output, for modifying the subset of scale factors accessed from said memory, so that said amplitude envelope is responsive to the touch with which said key is struck, wherein said electronic musical instrument separately provides the constituent Fourier components of the generated note, and further comprising:

component modification means, cooperating with said instrument, for modifying the constituent Fourier components in response to said transducer output.

5. A touch responsive system according to claim 4 wherein said component modification means including;

first circuitry for deleting from said generated note Fourier components of order higher than some maximum order $n_{max}$, and second circuitry for establishing said maximum order $n_{max}$ in response to said transducer output.

6. A touch responsive control system for a polyphonic keyboard electronic musical instrument including a plurality of tone generators each producing a tone in response to depression of a key assigned to that generator, comprising;

a plurality of touch responsive transducers each associated with a corresponding keyboard key, each transducer providing an analog output, an analog-to-digital converter, multiplexer means for connecting the analog outputs of key-actuated one of said transducers to the input of said analog-to-digital converter on a time shared basis, utilization means in said electronic musical instrument and receiving the output of said analog-to-digital converter, for modifying the generated tone in response to the output of the transducer that is connected to said converter via said multiplexer means, and wherein each tone generator utilizes a set of amplitude scale factors to establish the attack/ decay amplitude envelope of the tone produced by that generator, one of said generators being assigned to each selected key, the digital output of said converter being supplied to said one generator for utilization thereby when the analog output of the transducer associated with the selected key is connected to said converter by said multiplexer means.

7. A touch responsive control system according to claim 6 wherein each transducer is responsive to the force with which the associated key is struck.

8. A touch responsive control system for a keyboard electronic musical instrument of the type wherein a note is generated upon depression of a corresponding keyboard key, comprising;

a touch responsive transducer associated with each keyboard key, each transducer providing an output signal indicative of the force or velocity with which the corresponding key is depressed, a memory storing a set of amplitude scale factors that establish the amplitude envelope of the note generated upon depression of a selected key, access control circuitry for accessing a subset of said scale factors in a certain order, said access control circuitry accessing scale factors from sequential storage locations in said memory, scaler means in said musical instrument for scaling the amplitude of the note being generated in response to an amplitude scale factor supplied thereto, and touch response amplitude modification means for altering the accessed scale factors in response to the output of the touch responsive transducer for the key associated with the note being generated, the altered scale factors being supplied to said scaler means for utilization thereby, and wherein said modification means comprises circuitry, cooperating with said access control circuitry, for altering the initially accessed storage location in response to the output of the touch responsive transducer for said note-associated key, so that the maximum envelope amplitude is controlled in response to the force or velocity with which said selected key is depressed.

9. A touch responsive control system according to claim 8 wherein said electronic musical instrument is of the type wherein individual constituent Fourier components are evaluated and summed to compute the sample point amplitudes of a waveshape associated with the note being generated, the relative amplitude of each such component being established by a harmonic coefficient, and wherein said scaler means comprises a multiplier for multiplying the harmonic coefficient for each component by the amplitude scale factor supplied thereto.

10. A touch responsive control system for a keyboard electronic musical instrument of the type wherein a note is generated upon depression of a corresponding keyboard key, comprising;

a touch responsive transducer associated with each keyboard key, a memory storing a set of scale factors, access control circuitry for accessing a subset of said scale factors in a certain order, scaler means in said musical instrument for scaling the amplitude of the note being generated in response to an amplitude scale factor supplied thereto, and touch response amplitude modification means for altering the accessed scale factors in response to the output of the touch responsive transducer for the key associated with the note being generated, the altered scale factors being supplied to said scaler means for utilization thereby, wherein said electronic musical instrument is of the type wherein individual constituent Fourier components are evaluated and summed to compute the sample point amplitudes of a waveshape associated with the note being generated, and further comprising;

component modification means for altering which Fourier components are included in the waveshape amplitude summation in response to the output of the touch responsive transducer for said note-associated key.

11. A touch responsive control system according to claim 8 wherein said electronic musical instrument comprises a storage device containing a waveshape that is repetitively accessed from a memory at a rate corresponding to the fundamental frequency of the selected note, said accessed waveshape being scaled in amplitude by said scaler means.

12. A touch responsive system for a keyboard electronic musical instrument of the type wherein a note is generated upon depression of a keyboard key, comprising:

a touch responsive transducer associated with a key of said instrument, a memory storing a set of amplitude scale factors, access means for accessing a subset of said scale factors from said memory in a preselected order, the accessed scale factors being utilized by said instrument to control the amplitude envelope of the generated note, control means, responsive to said transducer output, for modifying the subset of scale factors accessed from said memory, so that said amplitude envelope is responsive to the touch with which said key is struck, and wherein said touch responsive transducer comprises:

an air cylinder having a piston therein, and a shaft connecting said piston to a keyboard key of that instrument, said cylinder having an outlet port for air that is pressurized by displacement of said piston when said key is depressed, a code wheel mounted for rotation about an axis, said wheel having a lever extending therefrom into the path of air emergent from said cylinder outlet port, said wheel being rotationally biased in a direction urging said lever toward said outlet port, and means for providing a digital signal indicative of angular displacement of said code wheel, whereby when said key is struck, the air emergent from said outlet port will impinge on said lever and cause rotation of said code wheel, the resultant digital signal being proportional to the force with which said key is struck.

13. A touch responsive control system according to claim 6 wherein each transducer is responsive to the velocity of the struck key past a specific position.

* * * * *